US011264721B2

(12) United States Patent
Nguyen

(10) Patent No.: US 11,264,721 B2
(45) Date of Patent: Mar. 1, 2022

(54) ANTENNA, CONFIGURATION METHOD OF ANTENNA AND WIRELESS COMMUNICATION DEVICE

(71) Applicant: NEC CORPORATION, Tokyo (JP)

(72) Inventor: Tung Nguyen, Tokyo (JP)

(73) Assignee: NEC CORPORATION, Tokyo (JP)

( * ) Notice: Subject to any disclaimer, the term of this patent is extended or adjusted under 35 U.S.C. 154(b) by 72 days.

(21) Appl. No.: 16/497,550

(22) PCT Filed: Feb. 7, 2018

(86) PCT No.: PCT/JP2018/004123
§ 371 (c)(1),
(2) Date: Sep. 25, 2019

(87) PCT Pub. No.: WO2018/179870
PCT Pub. Date: Oct. 4, 2018

(65) Prior Publication Data

US 2021/0111490 A1 Apr. 15, 2021

(30) Foreign Application Priority Data

Mar. 28, 2017 (JP) ..... JP2017-063248

(51) Int. Cl.
*H01Q 9/04* (2006.01)

(52) U.S. Cl.
CPC ..... *H01Q 9/045* (2013.01)

(58) Field of Classification Search
CPC ..... H01Q 1/523; H01Q 5/357; H01Q 9/045; H01Q 9/0485; H01Q 21/065; H01Q 21/24
See application file for complete search history.

(56) References Cited

U.S. PATENT DOCUMENTS 6,288,677 B1 * 9/2001 Fink ..... H01Q 9/0435 343/700 MS
6,531,984 B1 * 3/2003 Johannisson ..... H01Q 1/38 343/700 MS (Continued)

FOREIGN PATENT DOCUMENTS

JP 1-29083 B2 6/1989
JP 2-179008 A 7/1990

(Continued)

OTHER PUBLICATIONS

Notice of Reasons for Refusal dated Nov. 17, 2020 from the Japanese Patent Office in Application No. 2019-552297.

(Continued)

*Primary Examiner* — Tung X Le
(74) *Attorney, Agent, or Firm* — Sughrue Mion, PLLC

(57) ABSTRACT

One end of a second feeding line is connected to a first feeding line configured to transmit a first polarization at a first position and the other end is connected to a patch at a second position. One end of a third feeding line is connected to the first feeding line and the other end is connected to the patch at a third position. One end of a fourth feeding line is connected to the patch at a fourth position and configured to transmit a second polarization, wavelengths of the first and second polarizations being the same as each other. The second and third feeding lines are configured to cause the first polarization at the second position to be in opposite phase to the first polarization at the third position. A distance between the second and fourth positions is equal to a distance between the third and fourth positions.

12 Claims, 15 Drawing Sheets

(56) References Cited

U.S. PATENT DOCUMENTS

| | | | | |
|---|---|---|---|---|
| 2002/0018019 | A1* | 2/2002 | Fourdeux | H01Q 25/007 343/700 MS |
| 2004/0095278 | A1* | 5/2004 | Kanemoto | H04B 7/10 343/700 MS |
| 2011/0109524 | A1* | 5/2011 | Saily | H01Q 21/08 343/893 |
| 2014/0225782 | A1* | 8/2014 | Sanford | H01Q 9/0428 343/700 MS |
| 2017/0365934 | A1* | 12/2017 | Wilkins | H01Q 9/0421 |

FOREIGN PATENT DOCUMENTS

| | | | |
|---|---|---|---|
| JP | 2004-032046 | A | 1/2004 |
| JP | 2005-286854 | A | 10/2005 |
| JP | 2010-541443 | A | 12/2010 |
| WO | 95/22210 | A2 | 8/1995 |

OTHER PUBLICATIONS

D. Vollbracht, "Understanding and optimizing microstrip patch antenna cross polarization radiation on element level for demanding phased array antennas in weather radar applications", Adv. Radio Sci., 2015, pp. 251-268, vol. 13.

International Search Report for PCT/JP2018/004123 dated Apr. 17, 2018 [PCT/ISA/210].

Written Opinion for PCT/JP2018/004123 dated Apr. 17, 2018 [PCT/ISA/237].

* cited by examiner

ANTENNA, CONFIGURATION METHOD OF ANTENNA AND WIRELESS COMMUNICATION DEVICE

CROSS REFERENCE TO RELATED APPLICATIONS

This application is a National Stage of International Application No. PCT/JP2018/004123, filed on Feb. 7, 2018, which claims priority from Japanese Patent Application No. 2017-063248, filed on Mar. 28, 2017, the contents of all of which are incorporated herein by reference in their entirety.

TECHNICAL FIELD

The present invention relates to an antenna, a configuration method of antenna and a wireless communication device.

BACKGROUND ART

In mobile radio and wireless applications where size, weight, cost, performance, ease of fabrication and installation are of interests, low profile antennas are required. To meet these requirements, microstrip fed patch antennas have been widely selected because of their simple structure and inexpensiveness to manufacture them using modern printed-circuit-board (PCB) technology, and mechanical robustness when mounted on rigid surfaces.

On the other hand, antennas providing dual polarization, e.g., vertical V-polarization and horizontal H-polarization, are especially attractive from the viewpoints of: (1) integration of transmitted (Tx) and received (Rx) antennas on the same platform for duplex communication systems; (2) polarization multiplexing to boost the channel capacity; and (3) polarization diversity to improve the integrity of the communication system. Thus, a coplanar two ports feed microstrip line is often employed to create a simple, compact structure for dual polarization patch antennas.

Further, an antenna including two output transmission lines in which the signals are in opposite phases to each other is disclosed (PTL1). In this configuration, a signal input to the input side transmission line are transmitted to the two output transmission lines via a ring transmission line and the two output transmission lines are connected to positions on the ring transmission line to cause the signals at the two output transmission lines to be in opposite phases to each other.

CITATION LIST

Patent Literature

PTL 1: Japanese Unexamined Patent Application Publication No. 2004-32046

Non Patent Literature

NPL 1: D. Vollbracht, "Understanding and optimizing microstrip patch antenna cross polarization radiation on element level for demanding phased array antennas in weather radar applications", Adv. Radio Sci., 13, 251-268, 2015.

SUMMARY OF INVENTION

Technical Problem

However, the dual polarized microstrip patch antennas with two feeds have a problem described below. FIG. 15 illustrates current flows of the polarization from one port to the other port. As illustrated in FIG. 15, the leak current LC flows from a one port to the other port and thereby this two feeds antenna has poor polarization purity. Thus, this kind of unbalanced feed also degrades the antenna pattern. Note that, since the configuration of the PTL1 is not for polarization, this problem cannot be overcome by applying the configuration of the PTL1 to the dual polarized microstrip patch antenna.

A well-known solution for this problem is to apply a balanced feed antenna with four feeds and two 180° out of phase transmission lines for dual polarizations (e.g. NPL1). This antenna structure is defined as differential fed patch antenna. Using this structure, an excellent port-to-port isolation of more than 40 dB can be realized. However, the microstrip feed lines of this structure cannot be formed on the same plane because there is an intersection of the feeding pattern for the horizontal polarization and the feeding pattern for the vertical polarization as shown in NPL1. Therefore, two different layers are needed for configuring the feed circuit including both of the feeding pattern for the horizontal polarization and the feeding pattern for the vertical polarization, and thereby that compromises the simplicity of the antenna structure.

The present invention has been made in view of the aforementioned circumstances and aims to achieve an antenna in which a feed circuit for dual polarizations is formed on the same layer and which can suppress cross polarization.

Solution to Problem

An antenna according to an aspect of the present invention includes: a patch; a first feeding line configured to transmit a first polarization, a second feeding line one end of which is connected to the first feeding line at a first position and the other end of which is connected to the patch at a second position; a third feeding line one end of which is connected to the first feeding line at the first position and the other end of which is connected to the patch at a third position; and a fourth feeding line one end of which is connected to the patch at a fourth position and configured to transmit a second polarization different from the first polarization, a wavelength of the second polarization being the same as a wavelength of the first polarization. The second and third feeding lines are configured to cause the first polarization at the second position to be in opposite phase to the first polarization at the third position when the first polarization is transmitted from the first position to the second and third positions, and a distance between the second and fourth positions is equal to a distance between the third and fourth positions.

A wireless communication device according to another aspect of the present invention includes: an antenna; a baseband unit configured to output a baseband signal and receive a demodulated received signal; and an RF unit configured to modulate the baseband signal and transmit the modulated signal via the antenna, and to demodulate a received signal via the antenna to output the demodulated signal to the baseband unit. The modulated signal and the received signal before modulated are orthogonal polarization signals. The antenna includes: a patch; a first feeding line configured to transmit a first polarization; a second feeding line one end of which is connected to the first feeding line at a first position and the other end of which is connected to the patch at a second position; a third feeding line one end of which is connected to the first feeding line at the first position and the other end of which is connected to the patch at a third position; and a fourth feeding line one end of which is connected to the patch at a fourth position and configured to transmit a second polarization different from the first polarization, a wavelength of the second polarization being the same as a wavelength of the first polarization. The second and third feeding lines are configured to cause the first polarization at the second position to be in opposite phase to the first polarization at the third position when the first polarization is transmitted from the first position to the second and third positions, and a distance between the second and fourth positions is equal to a distance between the third and fourth positions.

An configuration method of an antenna according to still another aspect of the present invention includes: connecting one end of a second feeding line to a first feeding line configured to transmit a first polarization at a first position and connecting the other end of the second feeding line to a patch at a second position; connecting one end of a third feeding line to the first feeding line at the first position and connecting the other end of the third feeding line to the patch at a third position; connecting one end of a fourth feeding line configured to transmit a second first polarization different from the first polarization to the patch at a fourth position, a wavelength of the second polarization being the same as a wavelength of the first polarization. The second and third feeding lines are configured to cause the first polarization at the second position to be in opposite phase to the first polarization at the third position when the first polarization is transmitted from the first position to the second and third positions, and a distance between the first and third positions is equal to a distance between the second and third positions.

Advantageous Effects of Invention

According to the present invention, it is possible to achieve an antenna in which a feed circuit for dual polarizations is formed on the same layer and which can suppress cross polarization.

DESCRIPTION OF EMBODIMENTS

Figure 1:
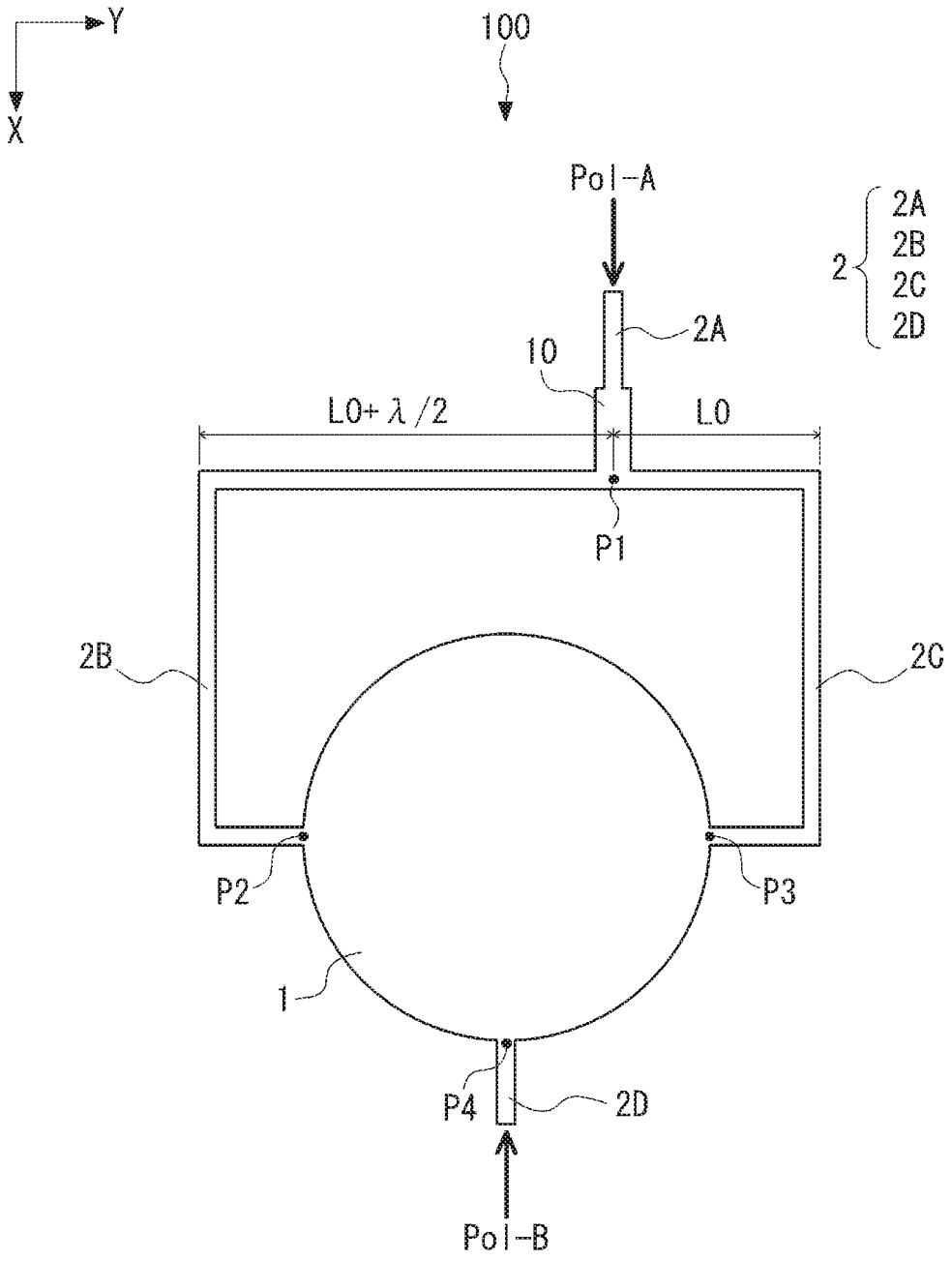
FIG. 1 is a top view schematically illustrating a configuration of an antenna according to a first exemplary embodiment.

Exemplary embodiments of the present invention will be described below with reference to the drawings. In the drawings, the same elements are denoted by the same reference symbols, and thus a repeated description is omitted as needed.

Here, for the sake of simplicity, a case where dual polarizations are transmitted from an antenna according to exemplary embodiments will be described below. However, it should be appreciated that the antenna according to exemplary embodiments described below can be applied to a case where the antenna receives the dual polarizations from outside.

First Exemplary Embodiment

An antenna 100 according to a first exemplary embodiment will be described. In the present exemplary embodiment, the antenna 100 is configured as a microstrip fed circular patch antenna. FIG. 1 is a top view schematically illustrating a configuration of the antenna 100 according to the first exemplary embodiment. The antenna 100 includes a patch 1 and a feeding circuit 2. The feeding circuit 2 includes a port A and port B in which dual polarizations are excited. Here, a polarization plane of one of the dual polarizations and a polarization plane of the other of the dual polarizations may be orthogonal to each other. Additionally, it should be appreciated that the wavelengths of the dual polarizations are the same as each other. Note that one of the dual polarizations is also referred to as a first polarization and the other of the dual polarizations is also referred to as a second polarization. In the port A, a Pol-A that is one of the dual polarizations (e.g., a horizontal H-polarization) is excited. In the port B, a Pol-B that is the other of the dual polarizations (e.g., a vertical V-polarization) is excited. The antenna 100 accommodates three feeds for a dual polarization mode.

Feeding lines 2A, 2B and 2C for the port A are configured as microstrip lines. The feeding lines 2A, 2B and 2C are also referred to as first to third feeding lines, respectively. The feeding line 2A is branched into the feeding lines 2B and 2C at a point P1 (also referred to as a first position). One end of the feeding line 2A is connected to a source of the Pol-A (not shown in the drawings) and the source provides the feeding line 2A with the Pol-A. The other end of the feeding line 2A is connected to one ends of the feeding lines 2B and 2C at the point P1. The other end of the feeding line 2B is connected to the patch 1 at a point P2 (also referred to as a second position) on the perimeter of the patch 1. The other end of the feeding line 2C is connected to the patch 1 at a point P3 (also referred to as a third position) on the perimeter of the patch 1. In the present exemplary embodiment, the points P2 and P3 may be located on opposite sides of the patch each. In other words, the points P2 and P3 may be located at positions symmetrical to each other with respect to the center of the patch.

In FIG. 1, a λ/4 transformer 10 is inserted between the point P1 and the feeding line 2A for impedance matching. However, the λ/4 transformer 10 is not an essential component of the antenna 100, and therefore the λ/4 transformer 10 may be omitted as appropriate.

The feeding lines 2B and 2C are configured to shift a phase of the Pol-A at the point P2 by π (180°) compared with a phase of the Pol-A at the point P3. In the present exemplary embodiment, the length of the feeding line 2B from the point P1 to the point P2 is λ/2 longer than the length of the feeding line 2C from the point P1 to the point P3. Specifically, in FIGS. 1 to 3, a Y-direction part of the feeding line 2B is 212 longer than a Y-direction part of the feeding line 2C the length of which is LO. Further, the phase difference of π (i.e. λ/2) between the points P2 and P3 is merely an example. Thus, when the phase difference of π+2nπ. (i.e. λ/2+nλ) between the points P2 and P3, where n is an integer equal to or more than zero, is generated, the antenna 100 can perform a function thereof in principle. In sum, when the Pol-A at the point P2 is in opposite phase to the Pol-A at the point P3.

A feeding line 2D for the port B is configured as a microstrip line. The feeding line 2D for the port B is also referred to as a fourth feeding line. One end of the feeding line 2D is connected to a source of the Pol-B (not shown in the drawings) and the source provides the feeding line 2D with the Pol-B. The other end of the feeding line 2D is connected to the patch 1 at a point P4 (also referred to as a fourth position). In the present exemplary embodiment, the point P4 is located at a position intermediate between points the P2 and P3 on the perimeter of the patch 1. In sum, the point P4 is a point shifted on the perimeter of the patch 1 by the π/2 (90°) from the point P2 in the counterclockwise direction and from the point P3 in the clockwise direction.

Figure 2:
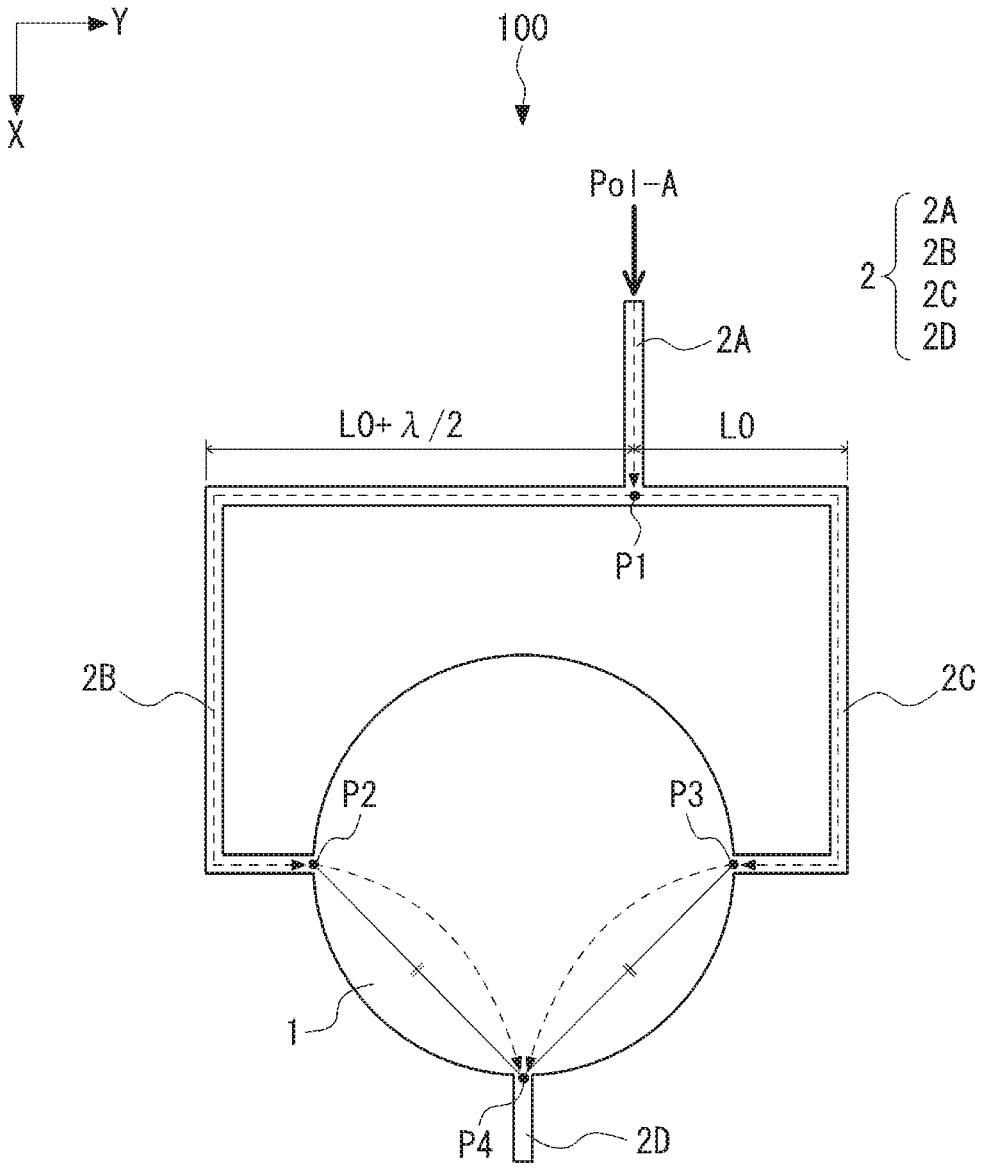
FIG. 2 is a top view schematically illustrating current flows of a Pol-A in the antenna according to the first exemplary embodiment.

An operation of the antenna 100 will be described. FIG. 2 is a top view schematically illustrating current flows of the Pol-A in the antenna 100 according to the first exemplary embodiment. Note that the λ/4 transformer 10 is omitted in FIG. 2 for simplicity. The Pol-A provided to the feeding line 2A is split into the feeding lines 2B and 2C then the split two Pol-As are transmitted to the points P2 and P3, respectively. As described above, the feeding lines 2B and 2C are configured to shift a phase of the Pol-A at the point P2 by π (180°) compared with a phase of the Pol-A at the point P3. In sum, the Pol-A at the point P2 is in opposite phase to the Pol-A at the point P3.

After that, currents of the Pol-A from the point P2 and the Pol-A from the point P3 flow to and join together at the point P4 of the port B. Since a distance between the points P2 and P4 and a distance between the points P3 and P4 are equal to each other, the Pol-A from the point P2 is in opposite phase to the Pol-A from the point P3 at the point P4. Therefore, the Pol-A from the point P2 and the Pol-A from the point P3 can be advantageously cancelled each other at the point P4.

Figure 3:
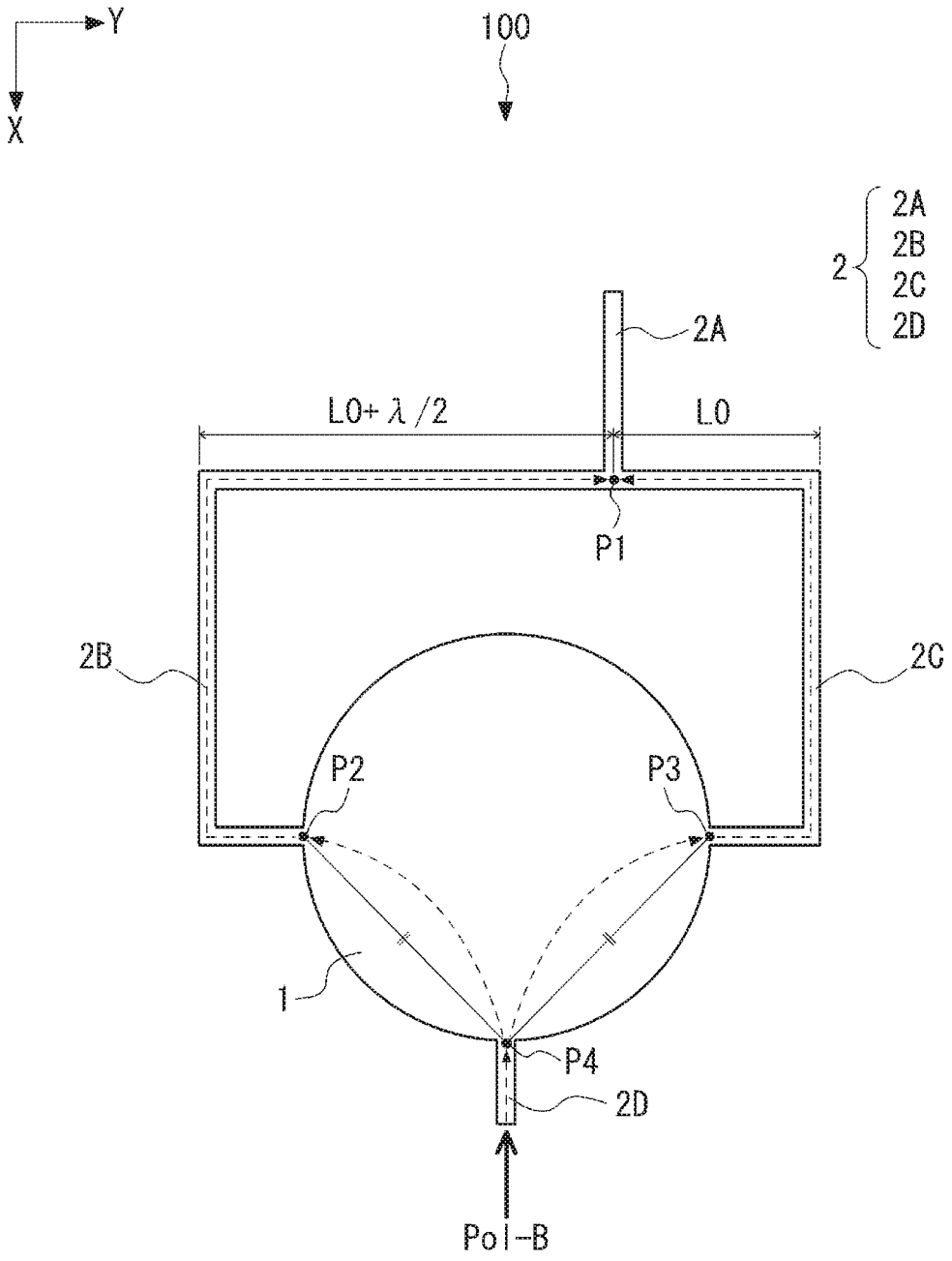
FIG. 3 is a top view schematically illustrating current flows of a Pol-B in the antenna according to the first exemplary embodiment.

FIG. 3 is a top view schematically illustrating current flows of the Pol-B in the antenna 100 according to the first exemplary embodiment. Note that the λ/4 transformer 10 is omitted in FIG. 3 for simplicity. The current of the Pol-B provided to the feeding line 2D flows to the point P4, and the one partial component of the Pol-B flows to the point P2 and the other partial component of the Pol-B flows to the point P3. Since the distance between the points P2 and P4 and the distance between the points P3 and P4 are equal to each other, the phases of the partial components at the points P2 and P3 are the same as each other. After that, the partial components flow to and join together at the point P1. As described above, the feeding lines 2B and 2C are configured to shift a phase of the Pol-A at the point P2 by π (180°) compared with a phase of the Pol-A at the point P3, and the wavelength of the Pol-B is the same as that of the pol-A. Thus, the phase of the partial component of the Pol-B from the point. P2 and the phase of the partial component of the Pol-B from the point P3 at the point P1 are different from each other by π (180°). In sum, the partial component of the Pol-B from the point P2 is in opposite phase to the partial component from the point P3 of the Pol-B at the point P1. Therefore, the partial components of the Pol-B from the points P2 and P3 can advantageously cancel each other at the point P1.

Next, an effect of the antenna 100 will be described with reference to a comparison example. Here, for observing isolation improvements of the antennas according to the first exemplary embodiment and the comparison example, Ansoft (Registered Trademark) HFSS (High Frequency Structure Simulator) ver.15 was used for modelling and simulation. Design frequency is 5.2 GHz. For single feed line, 50-Ohm impedance matching is realized by numerically optimizing the overlaps between microstrip lines and Teflon spacer (Registered Trademark) (not illustrated in the drawings for simplicity). For 180° out of phase feed line, λ/4 transformer is adopted for impedance matching.

Figure 4:
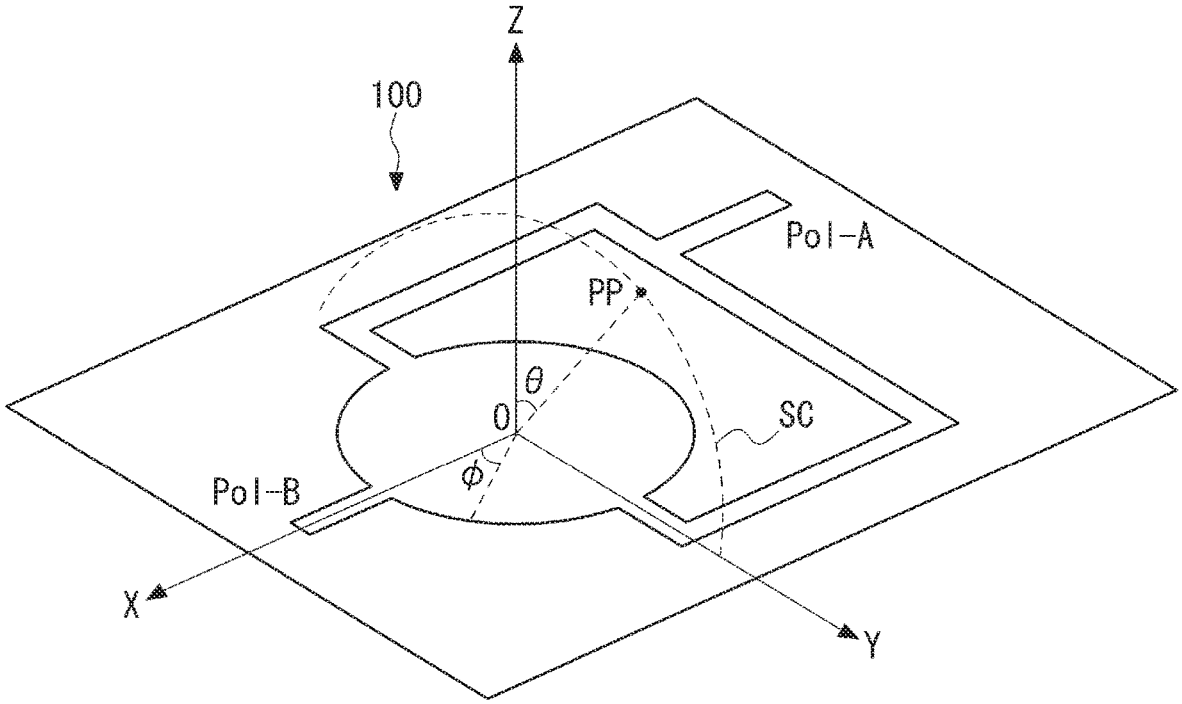
FIG. 4 is a perspective view schematically illustrating a HFSS model of the antenna according to the first exemplary embodiment.

FIG. 4 is a perspective view schematically illustrating a HFSS model of the antenna 100 according to the first exemplary embodiment. As illustrated in FIG. 4, the center of the patch 1 is on an origin O. The points P1 and P4 are on an X-axis and the points P2 and P3 are on a Y-axis. A Z-axis is a vertical direction with respect to the principal surface (an X-Y Plane) of the patch 1. In FIG. 4, θ represents an elevation angle and φ represents an azimuth angle in polar coordinate display.

Figure 5:
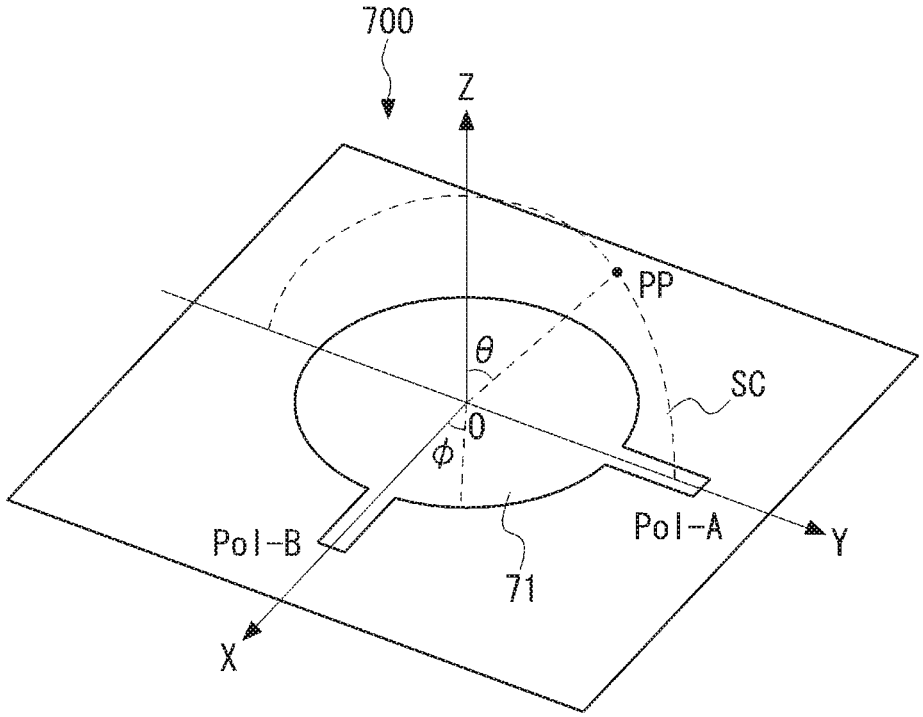
FIG. 5 is a perspective view schematically illustrating a HFSS model of an antenna according to a comparison example.

FIG. 5 is a perspective view schematically illustrating a HFSS model of an antenna 700 according to the comparison example. As illustrated in FIG. 5, a center of the patch 71 of the antenna 700 is on the origin O. A feeding line of a port A is on the Y-axis and a feeding line of a port B is on the X-axis. A Z-axis is a vertical direction with respect to the principal surface (the X-Y Plane) of the patch 1. In FIG. 5, as in FIG. 4, θ represents the elevation angle and φ represents the azimuth angle in polar coordinate display.

Figure 6:
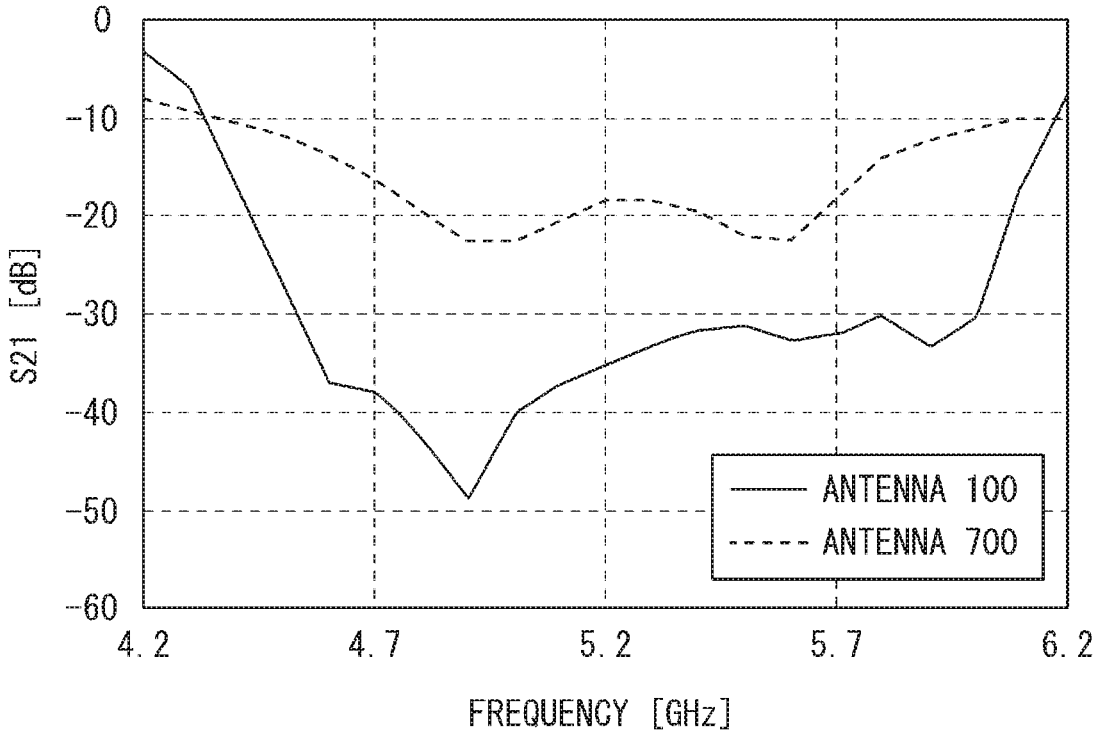
FIG. 6 is a diagram illustrating port-to-port isolation of the antenna according to the first exemplary embodiment and the antenna according to the comparison example.

FIG. 6 is a diagram illustrating port-to-port isolation of the antenna 100 and the antenna 700. In FIG. 6, the horizontal axis represents a frequency of the polarizations and the vertical axis represents a S21 parameter. A solid line represents the port-to-port isolation of the antenna 100 and a dashed line represents the port-to-port isolation of the antenna 700 according to the comparison example. As shown in FIG. 6, the port-to-port isolation of the antenna 100 is clearly improved as compared with the antenna 700. Specifically the port-to-port isolation improvement of the antenna 100 is more than 10 dB, and further more than 30 dB improvement is achieved over 29% of the bandwidth.

Figure 7:
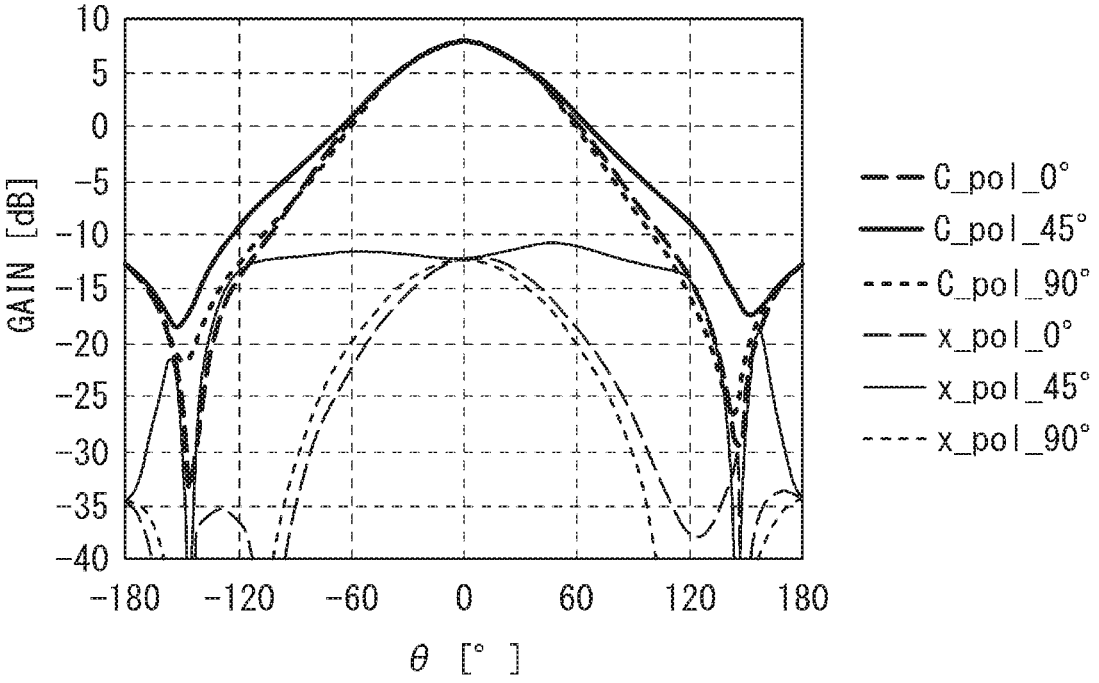
FIG. 7 is a diagram illustrating a radiation pattern of the Pol-A of the antenna according to the comparison example.
Figure 8:
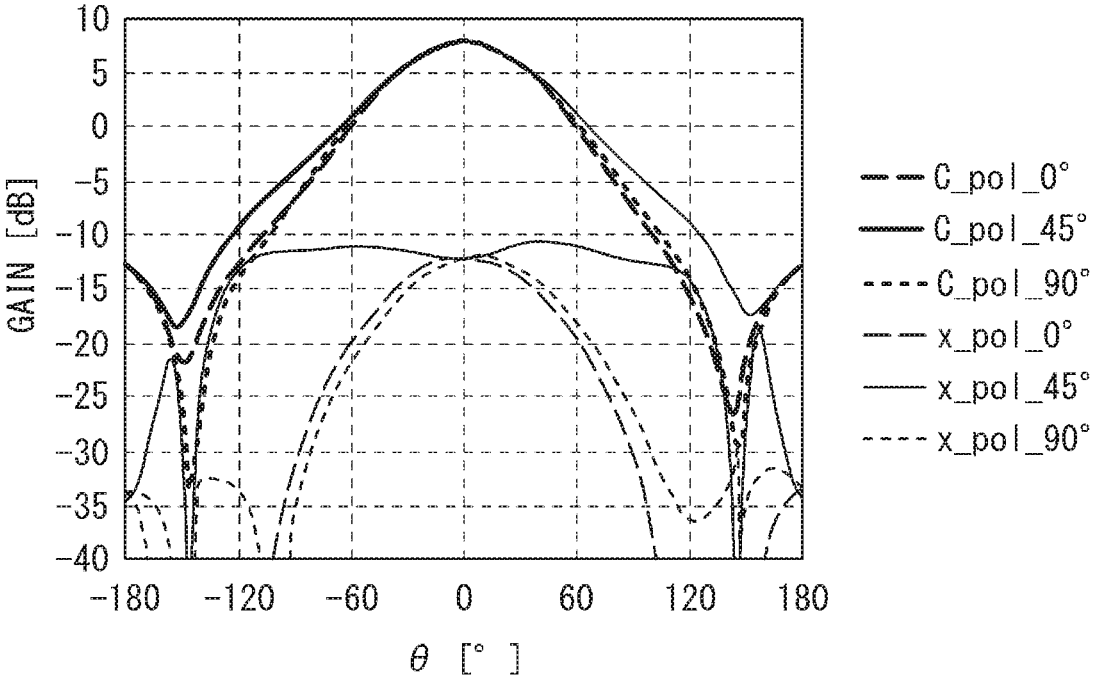
FIG. 8 is a diagram illustrating a radiation pattern of the Pol-B of the antenna according to the comparison example.
Figure 9:
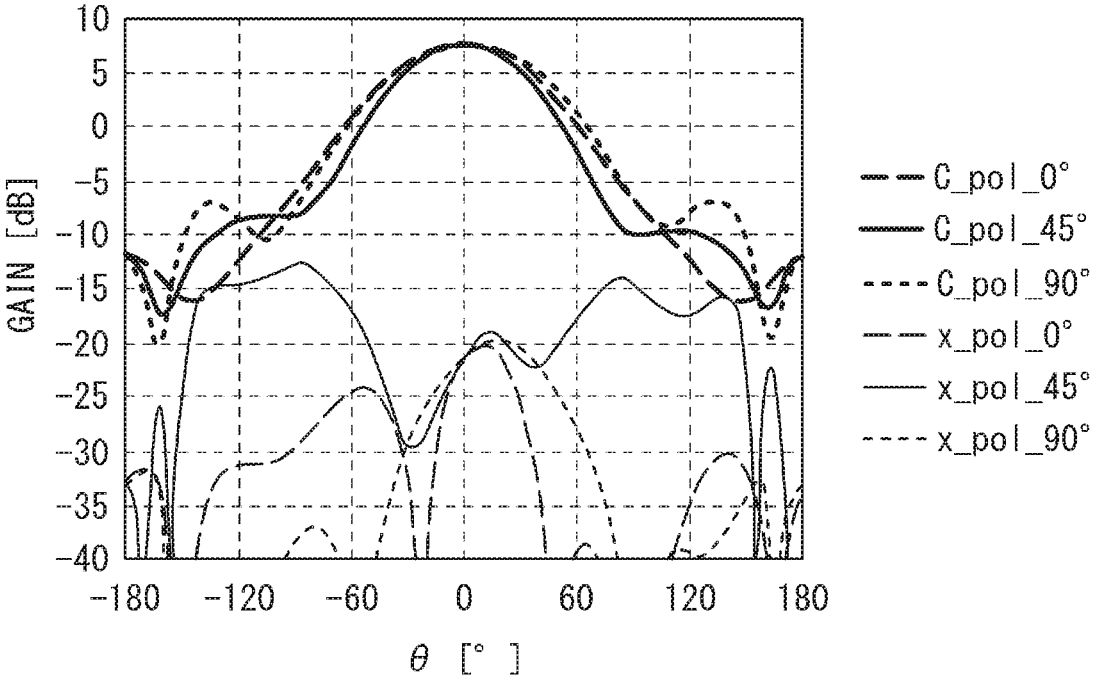
FIG. 9 is a diagram illustrating a radiation pattern of the Pol-A of the antenna according to the first exemplary embodiment.
Figure 10:
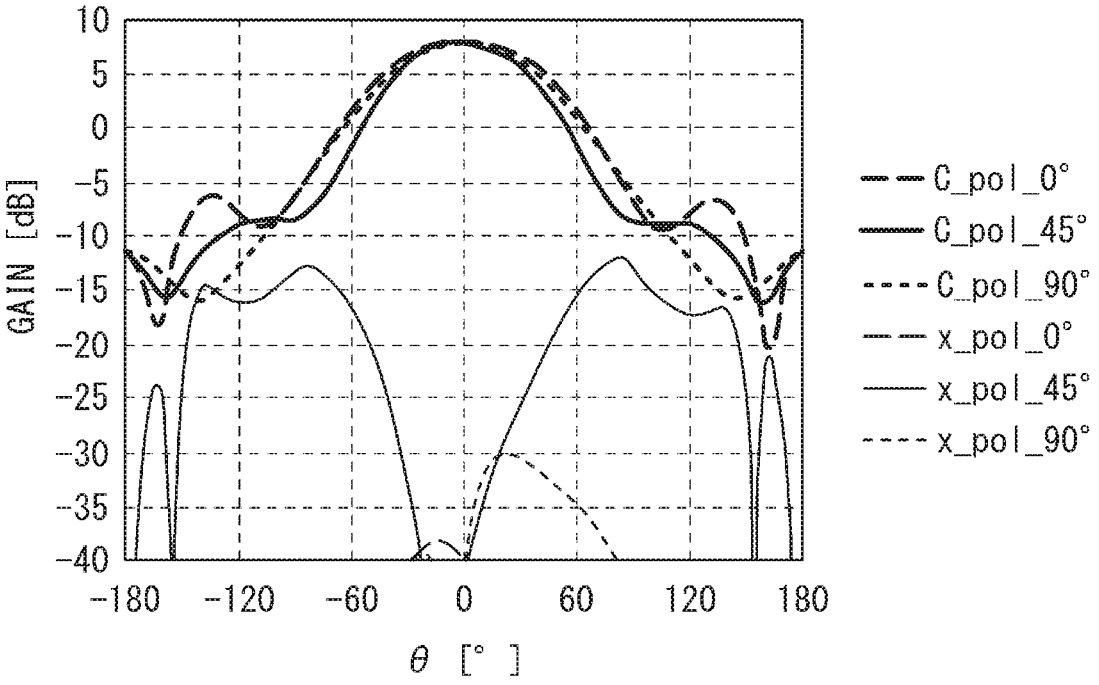
FIG. 10 is a diagram illustrating showing a radiation pattern of the Pol-B of the antenna according to the first exemplary embodiment.

FIGS. 7 and 8 are diagrams illustrating radiation patterns of the Pol-A and Pol-B of the antenna 700 according to the comparison example, respectively. FIGS. 9 and 10 are diagrams illustrating radiation patterns of the Pol-A and Pol-B of the antenna 100 according to the first exemplary embodiment, respectively. The horizontal axis represents an angle formed by the Z-axis and a line passing through the origin O and a point PP on a semicircle SC in the Y-Z plane as illustrated in FIGS. 4 and 5. The vertical axis represents the gain at the point PP. FIGS. 7 to 10 illustrate the radiation pattern on a cut plane at the azimuth angle φ that is an angle from the x-axis to the projection of the cut plane onto xy-plane when the azimuth angle φ is 0°, 45° and 90°. "C_pol_0°", "C_pol_45°" and "C_pol_90°" indicate the radiation patterns of the main polarization observed on the cut plane at φ=0°, φ=40° and φ=90°, respectively. "X_pol_0°", "X_pol_45°" and "X_pol_90°" indicate the radiation patterns of the cross polarization observed on the cut plane at φ=0°, φ=40° and φ=90°, respectively.

As illustrated in FIGS. 7 to 10, it can be understood that the antenna 100 can suppress the cross polarization and the Cross Polarization Discrimination (XPD) of more than 28 dB is achieved as compared with only the XPD of 19 dB of the antenna 700 according to the comparison example.

As described above, according to the configuration of the antenna 100, it is possible to achieve the antenna capable of suppressing the effect of the leak current of the dual polarizations with simple configuration. Therefore, according to the configuration, cross polarization, or an effect of polarization interference can be advantageously suppressed.

Further, according to the configuration, the feeding line of the Port A, the feeding line of the port B (in other words, the feeding circuit) and the patch can be provided in the same conductive layer without an intersection. Therefore, the size of the antenna can be advantageously reduced. Additionally, the antenna 100 that is a microstrip fed dual polarization patch antenna can be easily printed on one layer, which ease a fabrication process therefor and lower the cost for fabrication, especially when a printing array structure is fabricated.

Second Exemplary Embodiment

Figure 11:
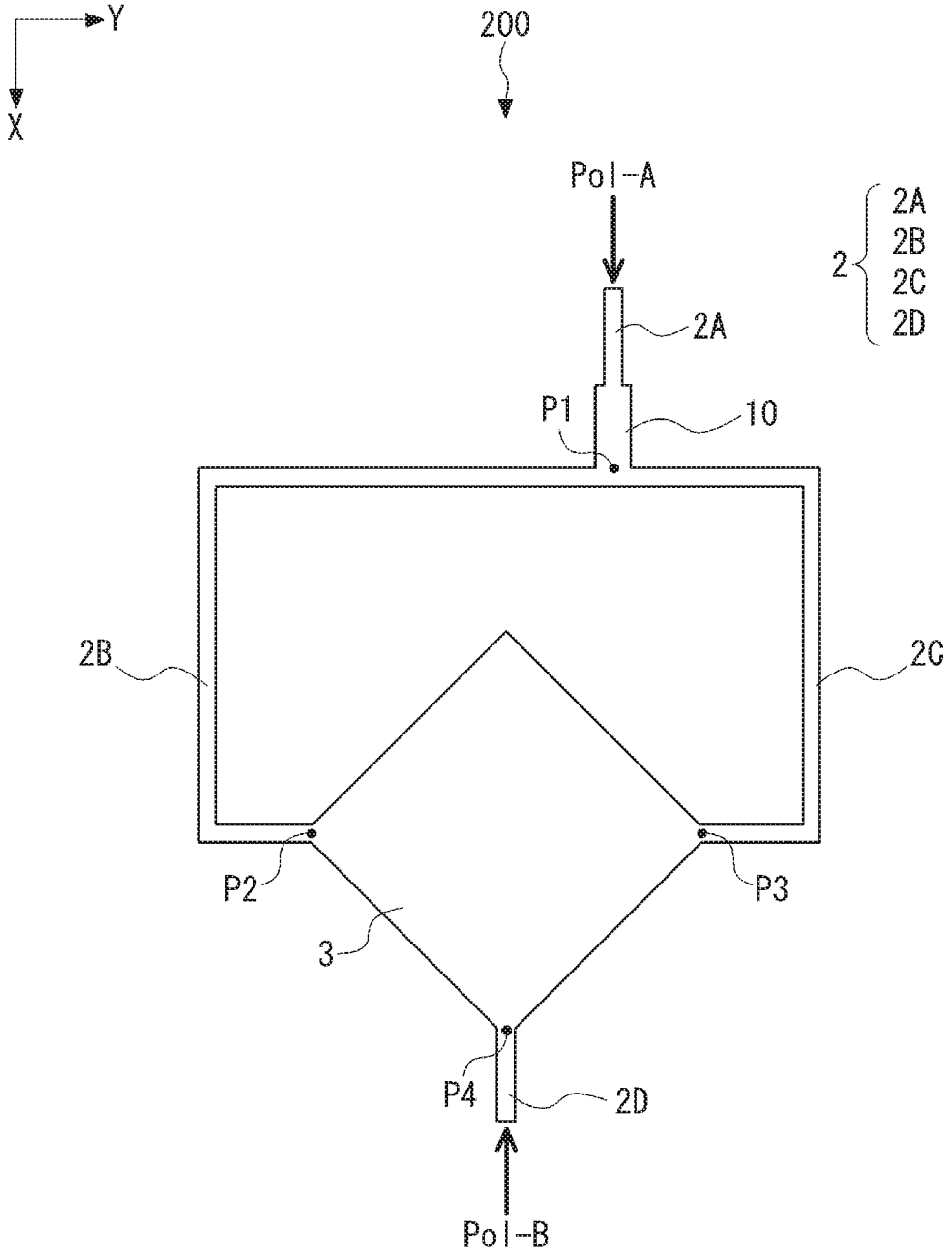
FIG. 11 is a top view of a configuration of an antenna according to a second exemplary embodiment.

An alternative configuration of the antenna 100 according to the first exemplary embodiment will be described. FIG. 11 is a top view of a configuration of an antenna 200 according to a second exemplary embodiment.

The antenna 200 has a configuration in which the patch 1 in the antenna 100 according to the first exemplary embodiment is replaced with a patch 3. The patch 3 is a square shape patch. The points P2 to P4 are placed at different vertexes of the patch 3, respectively.

In this configuration, the distance from the point P2 to the point P4 and the distance from the point P3 to the point P4 are also equal to each other. Therefore, two Pol-A components can cancel each other at the point P4 and two Pol-B components can cancel each other at the point P1 in the antenna 200 as in the case of the antenna 100.

Third Exemplary Embodiment

Figure 12:
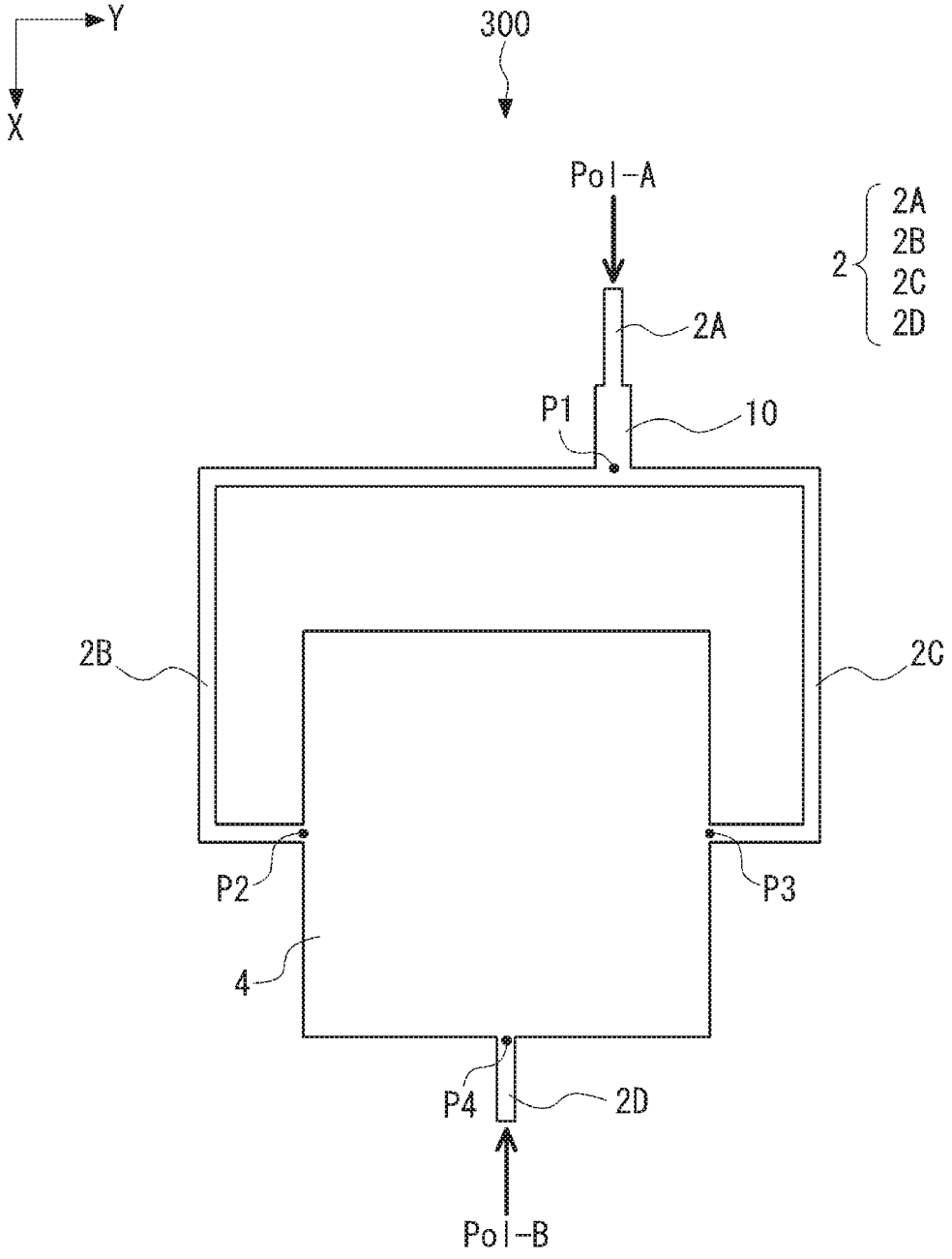
FIG. 12 is a top view of a configuration of an antenna according to a third exemplary embodiment.

Another alternative configuration of the antenna 100 according to the first exemplary embodiment will be described. FIG. 12 is a top view of a configuration of an antenna 300 according to a third exemplary embodiment.

The antenna 300 has a configuration in which the patch 1 in the antenna 100 according to the first exemplary embodiment is replaced with a patch 4. The patch 4 is a square shape patch. The points P1 to P3 are placed at different midpoints of sides the square, respectively. In other words, the patch 4 can be configured by rotating the patch 3 by 45° around an axis passing through the center of the patch 3 and perpendicular to the principal surface of the patch 3.

In this configuration, the distance from the point P2 to the point P4 and the distance from the point P3 to the point P4 are also equal to each other. Therefore, two Pol-A components can cancel each other at the point P4 and two Pol-B components can cancel each other at the point P1 in the antenna 300 as in the cases of the antennas 100 and 200.

Fourth Exemplary Embodiment

Figure 13:
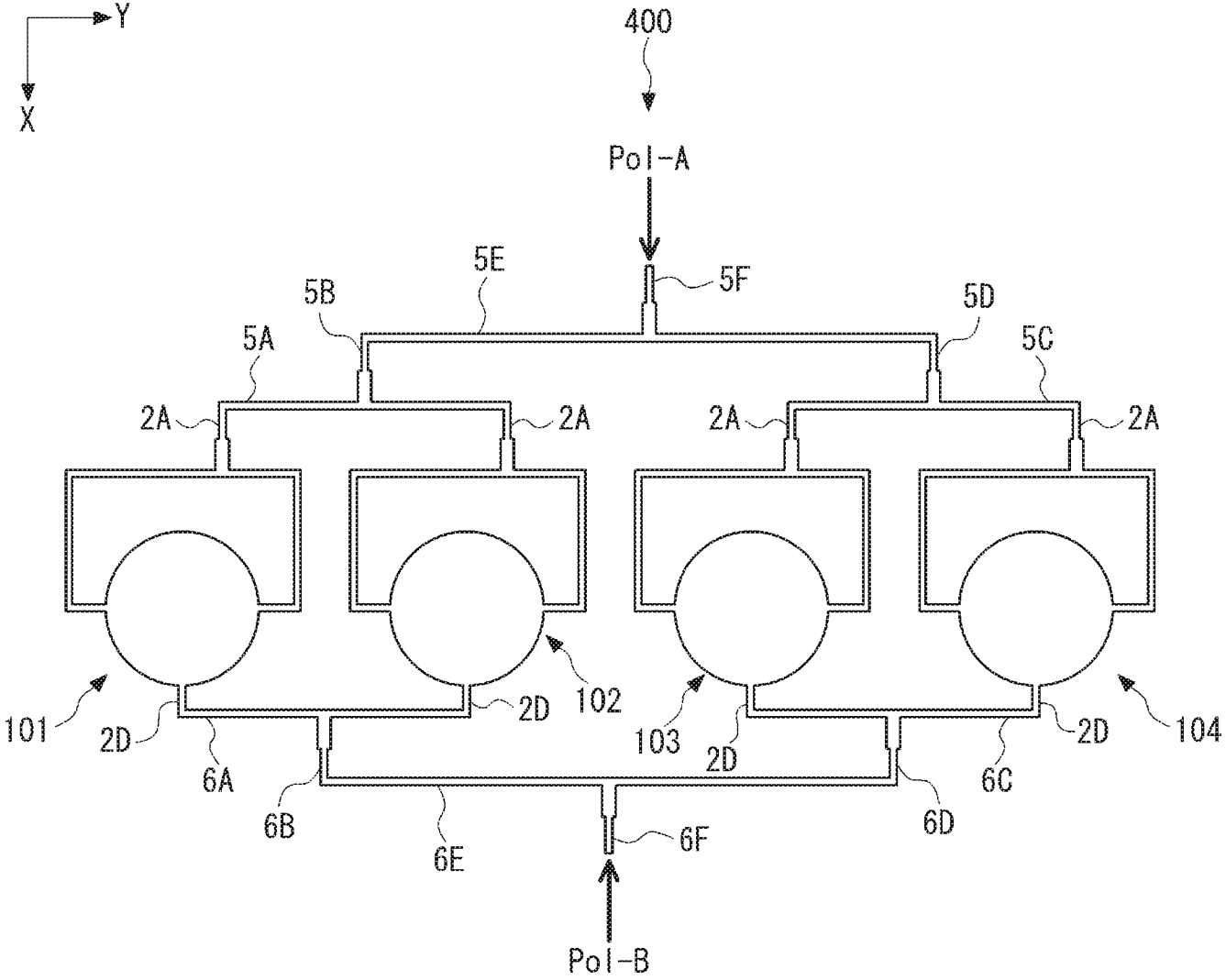
FIG. 13 is a top view illustrating a configuration of an antenna array according to a fourth exemplary embodiment.

An antenna array 400 according to a fourth exemplary embodiment including a plurality of the antenna 100 according to the first exemplary embodiment will be described. FIG. 13 is a top view illustrating a configuration of the antenna array 400 according to the fourth exemplary embodiment.

In an example illustrated in FIG. 13, the antenna array 400 includes four antennas 100. In FIG. 13, the four antennas 100 are indicated by numerical signs 101 to 104, respectively.

The feeding lines 2A of the antenna 101 and 102 are connected to each other by a feeding line 5A. A feeding line 5B extends in a direction perpendicular to the feeding line 5A from a midpoint of the feeding line 5A. The feeding lines 2A of the antenna 103 and 104 are connected to each other by a feeding line 5C. A feeding line 5D extends in a direction perpendicular to the feeding line 5C from a midpoint of the feeding line 5C. Here, a length of the feeding line 5C is the same as that of the feeding line 5A, a length of the feeding line 5D is the same as that of the feeding line 5B and the feeding lines 5B and 5D extends in parallel. The end of the feeding line 5B which is opposite to the feeding line 5A side and the end of the feeding line 5D which is opposite to the feeding line 5C are connected to each other by a feeding line 5E. A feeding line 5F extends in a direction perpendicular to the feeding line 5E from a midpoint of the feeding line 5E to a Pol-A feeding point FPA (also referred to as a first port). Accordingly, distances from the Pol-A feeding point FPA to the antenna 101 to 104 are equal to each other. In this configuration, the source (not shown in the drawings) may provide the Pol-A feeding point FPA with the Pol-A.

The feeding lines 2D of the antenna 101 and 102 are connected to each other by a feeding line 6A. A feeding line 6B extends in a direction perpendicular to the feeding line 6A from a midpoint of the feeding line 6A. The feeding lines 2D of the antenna 103 and 104 are connected to each other by a feeding line 6C. A feeding line 6D extends in a direction perpendicular to the feeding line 6C from a midpoint of the feeding line 6C. Here, a length of the feeding line 6C is the same as that of the feeding line 6A, a length of the feeding line 6D is the same as that of the feeding line 6B and the feeding lines 6B and 6D extends in parallel. The end of the feeding line 6B which is opposite to the feeding line 6A side and the end of the feeding line 6D which is opposite to the feeding line 6C are connected to each other by a feeding line 6E. A feeding line 6F extends in a direction perpendicular to the feeding line 6E from a midpoint of the feeding line 6E to a Pol-B feeding point FPB (also referred to as a second port). Accordingly, distances from the Pol-B feeding point FPB to the antenna 101 to 104 are equal to each other. In this configuration, the source (not shown in the drawings) may provide the Pol-B feeding point FPB with the Pol-B.

According to this configuration, the antennas 101 to 104 can receive the Pol-A and the Pol-B in the same phase, respectively. Further, the antennas 101 to 104 can cancel the leak current as with the antenna 100. Therefore, the antennas 101 to 104 can radiate the dual polarizations in the same phase with high XPD so that antenna array 400 can advantageously radiate high power dual polarizations.

Fifth Exemplary Embodiment

Figure 14:
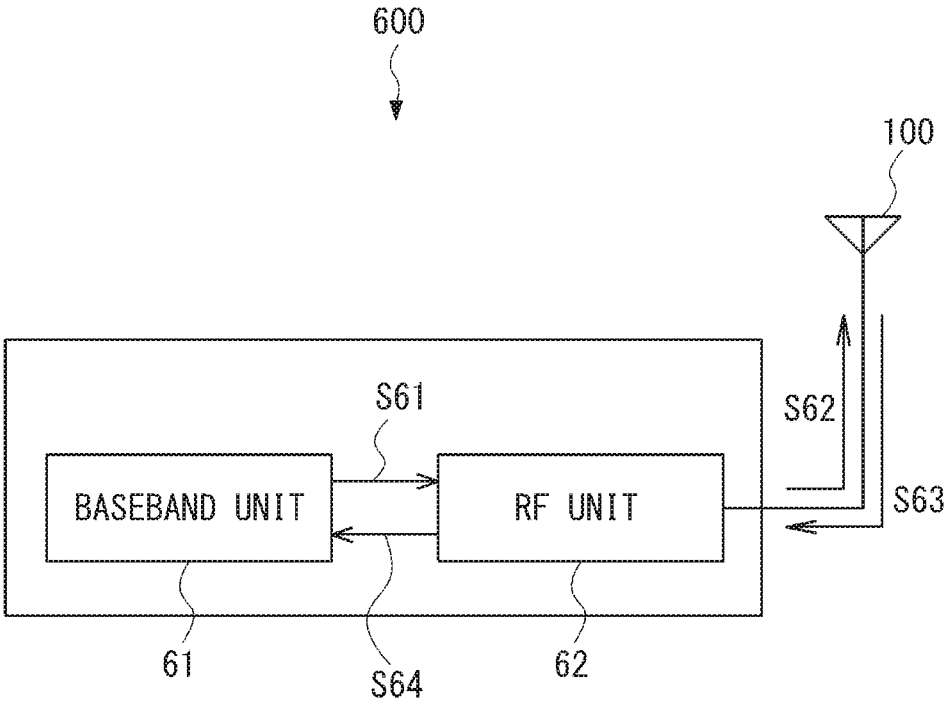
FIG. 14 is a block diagram schematically illustrating a configuration of a wireless communication device 600 according to a fifth exemplary embodiment.
Figure 15:
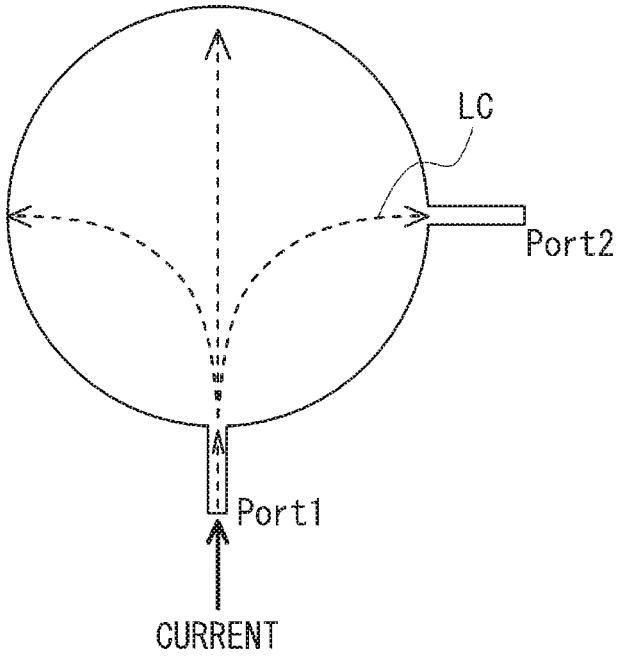
FIG. 15 is a diagram illustrating current flows of the polarization from one port to the other port.

A wireless communication device 600 according to a fifth exemplary embodiment will be described. FIG. 14 is a block diagram schematically illustrating a configuration of the wireless communication device 600 according to the fifth exemplary embodiment. The wireless communication device 600 includes the antenna 100 according to the first exemplary embodiment, a baseband unit 61 and a RF unit 62. The baseband unit 61 processes a baseband signal S61 and a received signal S64. The RF unit 62 modulates the baseband signal S61 from the baseband unit 61 and outputs a modulated a transmission signal S62 to the antenna 100. The RF unit 62 demodulates a received signal S63 and outputs the demodulated received signal S64 to the baseband unit 61. The antenna 100 radiates the transmission signal S62 and receives the received signal S63 radiated from an external antenna.

As described above, according the present configuration, it can be understood that the wireless communication device capable of communicating with outside can be specifically configured using the antenna 100 according to the first exemplary embodiment.

Other Exemplary Embodiment

Note that the present invention is not limited to the above exemplary embodiments and can be modified as appropriate without departing from the scope of the invention. For example, in the exemplary embodiments described above, the shapes of the patches of the antennas described above are merely examples. As far as the distance between the point P2 and the point P4 and the distance between the point P3 and the point P4 are equal to each other, various shapes can be taken for the patch.

In the fourth exemplary embodiment, the case where the four antennas constitute the antenna array is described. However, it is merely an example. Therefor the number of the antennas constituting the antenna array may be appropriately a plural number other than four.

The antenna, antenna array and wireless communication device according to the exemplary embodiments described above may be applied to a system such as a wireless LAN (Local Area Network), an access point and a base station, and thereby can be applied to communication with terminal devices (mobile terminals). In a backhaul, the antenna, antenna array and wireless communication device according to the exemplary embodiments described above may be also applied to communication between the base stations. Further, the antenna, antenna array and wireless communication device according to the exemplary embodiments described above may be applied to various communication methods such as LTE (Long Term Evolution).

While the present invention has been described above with reference to exemplary embodiments, the present invention is not limited to the above exemplary embodiments. The configuration and details of the present invention can be modified in various ways which can be understood by those skilled in the art within the scope of the invention.

REFERENCE SIGNS LIST

1, 3, 4 PATCHES
2 FEEDING CIRCUIT
2A TO 2D, 5A TO 5F, 6A TO 6F FEEDING LINES
10 λ/4 TRANSFORMER
61 BASEBAND UNIT
62 RF UNIT
100, 101 TO 104, 200, 300,700 ANTENNAS
400 ANTENNA ARRAY
600 WIRELESS COMMUNICATION DEVICE

The invention claimed is:

1. An antenna comprising:

a patch comprising a plurality of feeding line connection points, the plurality of feeding line connection points consisting of only three feeding line connection points;

a first feeding line configured to transmit a first polarization, a second feeding line having one end of which is connected to the first feeding line at a first position and another end of which is connected to the patch at one of the plurality of feeding line connection points at a second position;

a third feeding line having one end of which is connected to the first feeding line at the first position and another end of which is connected to the patch at one of the plurality of feeding line connection points at a third position; and a fourth feeding line having one end of which is connected to the patch at one of the plurality of feeding line connection points at a fourth position and configured to transmit a second polarization different from the first polarization, a wavelength of the second polarization being the same as a wavelength of the first polarization, wherein, the second and third feeding lines are configured to cause the first polarization at the second position to be in opposite phase to the first polarization at the third position when the first polarization is transmitted from the first position to the second and third positions, and a distance between the second and fourth positions is equal to a distance between the third and fourth positions.

2. The antenna according to claim 1, wherein a phase of the first polarization at one of the second and third positions is different from a phase of the first polarization at the other of the second and third positions by $\pi+2n\pi$, where n is an integer greater than or equal to zero.

3. The antenna according to claim 2, wherein a length of one of the second and third feeding lines is longer than a length of the other of the second and third feeding lines by $\lambda/2+n\lambda$, where $\lambda$ is the wavelength of the first and second polarizations.

4. The antenna according to claim 1, wherein a shape of the patch is a circle, the second to fourth positions are provided on a perimeter of the circle, the second and third positions are symmetrical with respect to a center of the circle, and the fourth position is provided at an intermediate position between the second and third positions on the perimeter of the circle.

5. The antenna according to claim 1, wherein a shape of the patch is a square, and the second to fourth positions are provided at different vertices of the square, respectively.

6. The antenna according to claim 1, wherein a shape of the patch is a square, and the second to fourth positions are provided at intermediate positions on different sides of the square, respectively.

7. The antenna according to claim 1, wherein polarization planes of the first and second polarizations are orthogonal to each other.

8. The antenna according to claim 1, wherein the first to fourth feeding lines and the patch are continuously formed on the same conductive layer.

9. The antenna according to claim 1, wherein each of the first to fourth feeding lines is a microstrip line.

10. An antenna array comprising:

a plurality of the antenna according to claim 1;

feeding lines configured to connect the first feeding lines of the antennas to a first port of the first polarization, distances between the first port and each of the first feeding lines of the antennas are equal; and feeding lines configured to connect the fourth feeding lines of the antennas to a second port of the second polarization, distances between the second port and each of the fourth feeding lines of the antennas are equal.

11. A wireless communication device comprising:

an antenna;

a baseband unit configured to output a baseband signal and receive a demodulated received signal; and an RF unit configured to modulate the baseband signal and transmit the modulated signal via the antenna, and to demodulate a received signal via the antenna to output the demodulated signal to the baseband unit, wherein the modulated signal and the received signal before modulated are orthogonal polarization signals, and the antenna comprises:

a patch comprising a plurality of feeding line connection points, the plurality of feeding line connection points consisting of only three feeding line connection points;

a first feeding line configured to transmit a first polarization;

a second feeding line having one end of which is connected to the first feeding line at a first position and another end of which is connected to the patch at one of the plurality of feeding line connection points at a second position;

a third feeding line having one end of which is connected to the first feeding line at the first position and another end of which is connected to the patch at one of the plurality of feeding line connection points at a third position; and a fourth feeding line having one end of which is connected to the patch at one of the plurality of feeding line connection points at a fourth position and configured to transmit a second polarization different from the first polarization, a wavelength of the second polarization being the same as a wavelength of the first polarization, wherein the second and third feeding lines are configured to cause the first polarization at the second position to be in opposite phase to the first polarization at the third position when the first polarization is transmitted from the first position to the second and third positions, and a distance between the second and fourth positions is equal to a distance between the third and fourth positions.

12. An configuration method of an antenna comprising a patch, the patch comprising a plurality of feeding line connection points, the plurality of feeding line connection points consisting of only three feeding line connection points, the method comprising:

connecting one end of a second feeding line to a first feeding line configured to transmit a first polarization at a first position and connecting another end of the second feeding line to a patch at one of the plurality of feeding line connection points at a second position;

connecting one end of a third feeding line to the first feeding line at the first position and connecting another end of the third feeding line to the patch at one of the plurality of feeding line connection points at a third position; and connecting one end of a fourth feeding line configured to transmit a second first polarization different from the first polarization to the patch at one of the plurality of feeding line connection points at a fourth position, a wavelength of the second polarization being the same as a wavelength of the first polarization, wherein the second and third feeding lines are configured to cause the first polarization at the second position to be in opposite phase to the first polarization at the third position when the first polarization is transmitted from the first position to the second and third positions, and a distance between the first and third positions is equal to a distance between the second and third positions.

* * * * *